US005352870A

United States Patent [19]

Daugherty et al.

[11] Patent Number: 5,352,870

[45] Date of Patent: Oct. 4, 1994

[54] STRIP HEATER WITH PREDETERMINED POWER DENSITY

[75] Inventors: Joseph P. Daugherty, Trenton, N.J.; Harold C. Wright, Holland, Pa.; Clement A. Berard, Jr., Hopewell Twp., N.J.

[73] Assignee: Martin Marietta Corporation, East Windsor, N.J.

[21] Appl. No.: 98,916

[22] Filed: Jul. 29, 1993

Related U.S. Application Data

[63] Continuation of Ser. No. 955,851, Sep. 29, 1992, abandoned.

[51] Int. Cl.[5] ..... H05B 3/54

[52] U.S. Cl. ..... 219/549; 338/203; 338/212; 338/260; 338/332

[58] Field of Search ..... 219/548, 549, 528, 529; 338/203, 212, 214, 211, 260, 272, 292, 332; 174/74 R, 84 R, 94 R; 439/492

[56] References Cited

U.S. PATENT DOCUMENTS

| | | | |
|---|---|---|---|
| 2,782,289 | 2/1957 | Nathanson | 219/528 |
| 3,257,498 | 6/1966 | Kahn | 219/549 |
| 3,274,528 | 9/1966 | Bermann | 338/203 |
| 3,327,271 | 6/1967 | Hornig | 338/203 |
| 3,611,275 | 10/1971 | Leddy et al. | 338/332 |
| 3,629,787 | 12/1971 | Wilson | 174/88 R |
| 3,758,703 | 9/1973 | Golden et al. | 174/94 R |
| 3,894,225 | 7/1975 | Chao | 439/492 |
| 3,983,528 | 9/1976 | King | 338/203 |
| 4,058,704 | 11/1977 | Shimuzu | 219/549 |
| 4,060,889 | 12/1977 | Zielinski | 174/94 R |
| 4,072,848 | 2/1978 | Johnson et al. | 219/549 |
| 4,173,035 | 10/1979 | Hoyt | 362/249 |
| 4,485,297 | 11/1984 | Grise et al. | 219/528 |
| 4,714,820 | 12/1987 | Morrison et al. | 338/203 |
| 4,721,848 | 1/1988 | Malone et al. | 219/504 |
| 4,774,397 | 9/1988 | Grise | 219/549 |
| 4,788,523 | 11/1988 | Robbins | 338/203 |

OTHER PUBLICATIONS

MINCO Products, Inc. Bulletin HS-3, "Thermal--Clear TM Thin-Film Heaters," Form 920402, pp. 1-2, dated Apr. 1992.

MINCO Products, Inc. letter dated Feb. 9, 1993 with attached invoices #66723 and 76215.

"Heating Materials Technical Guide," Flexwatt Corporation, pp. 1-4, date unknown.

Thermofoil Heater Model HK14029, MINCO Products, Inc., dated Sep. 18, 1991 (two pages).

*Primary Examiner*—Bruce A. Reynolds
*Assistant Examiner*—John A. Jeffery
*Attorney, Agent, or Firm*—William H. Meise; Clement A. Berard; Stephen A. Young

[57] ABSTRACT

A resistance strip heater includes a pair of elongated, mutually parallel electrical conductors or buses lying on a dielectric substrate. Each bus includes a conductive region extending toward the other conductor, and the locations of the conductive regions of the two buses alternate along the lengths thereof. An elongated resistance arrangement has its axis of elongation parallel to the buses, is physically supported between the buses, and is electrically connected to mutually adjacent ones of the conductive regions, so that the resistance arrangement is electrically connected across the buses. In a particular embodiment of the invention, the resistance arrangement is a plurality of elongated chip resistors arranged in an array. The substrate may be a polyimide sheet, and a corresponding cover sheet may be used. The strip heater can be cut virtually anywhere along its length without affecting its operability. Thus, the strip heater can be fabricated and stocked in long lengths, even by rolls, and be cut to any desired length as needed. Electrical power is applied to the power buses via crimped metal connectors or via access holes opened by removing perforated areas of the cover.

18 Claims, 2 Drawing Sheets

STRIP HEATER WITH PREDETERMINED POWER DENSITY

This is a continuation of Ser. No. 07/955,851, filed Sep. 29, 1992now abandoned.

The present invention relates generally to electrical resistance devices.

BACKGROUND OF THE INVENTION

Electrical resistance heaters are useful for controlling the temperature of objects of different shapes and sizes. The amount of heat, i.e. power dissipated by an electrical resistance heater, required is proportional to the size of the object. One application is to prevent the freezing of, or to thaw, pipes and tubes carrying fluids. Examples include water pipes located outdoors or underground, or in unheated interior spaces, rain gutters and downspouts, and the like. Other utilizations could include controlling the temperature of a fluid-filled line, as might be the case in an industrial or scientific process, or of fuel and oxidizer lines in a spacecraft, or of an aquarium. In many applications, a predetermined power density (watts per square inch) is desired.

Presently available resistance heaters include metal heater elements laminated between sheets of an insulating material, such as those available from Minco Products, Inc. of Minneapolis, Minn. These heaters are made in a multiplicity of fixed sizes and shapes, and predetermined resistances, in the hope that one suitable to a particular application will be available. This type of heater generally has a serpentine resistance element that covers almost the entire area of the heater so that it cannot be cut to a different size without destroying its operability. Thus, if the application changes, a different heater is needed. If a suitable one is not available, a custom-made heater is required. All this requires expenditure of extra time and money.

Accordingly, it would be desirable to have a resistance heater that would be adaptable to a variety of applications. Specifically, it is desirable to have a strip heater having a predetermined power density (and with known width, its power per unit of length) that can be simply cut to the desired size. This beneficially reduces the breadth and cost of inventory and permits virtually immediate adaptation to different applications and to changed applications.

SUMMARY OF THE INVENTION

The resistance device of the present invention includes first and second electrically conductive buses spaced apart on a flexible insulating substrate. Each bus includes conductive regions extending toward the other bus, and the conductive regions alternate along the lengths of the buses. A resistance arrangement is connected to alternate ones of the conductive regions, so the resistance arrangement is electrically connected across the buses. The resistance arrangement may be elongated. In a preferred embodiment of the invention, resistance elements are arranged in an ordered elongated array and each is connected between the first and second buses in an order corresponding to the order of the array.

DESCRIPTION OF THE INVENTION

Figure 1:
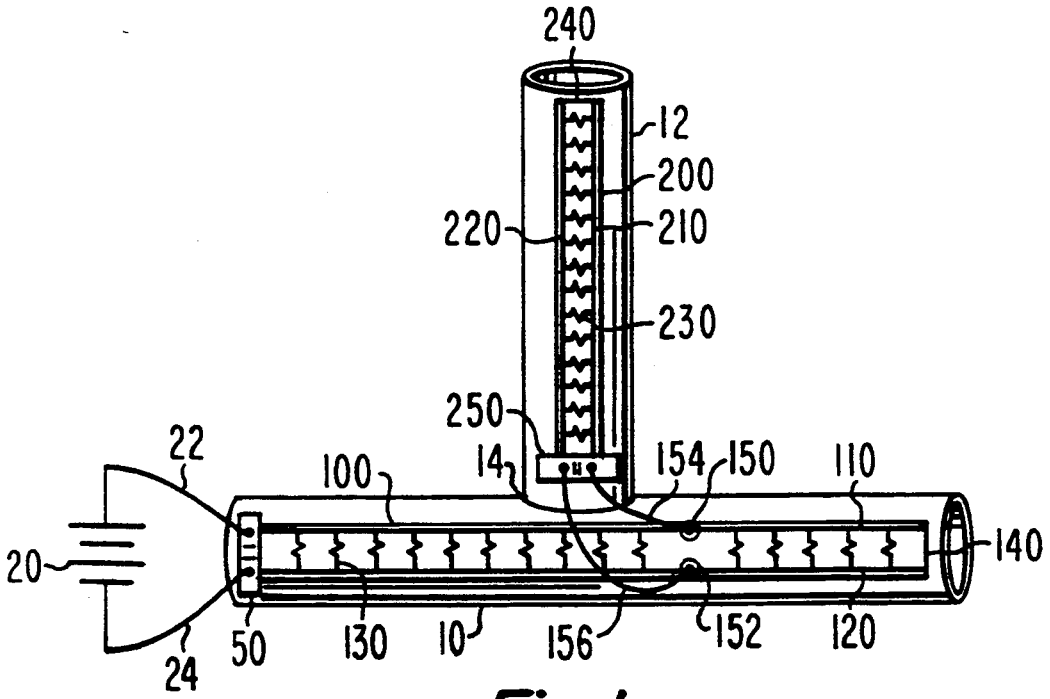
FIG. 1 shows resistance devices according to the present invention arranged on tubular pipes.

In FIG. 1, tubular pipes 10 and 12 are joined at a tee-shaped junction 14. Resistance heater 100 is affixed longitudinally along pipe 10 and resistance heater 200 along pipe 12 in the conventional manner. Heater 100 includes electrically-conductive power buses 110 and 120 on an insulated substrate and an ordered array of plural resistance elements 130 connected therebetween. Power buses 110 and 120, and resistance elements 130 may be covered by an insulating material. Heater 100 is cut to a length appropriate to that of pipe 10 at cut edge 140. Heater 200 includes electrically conductive power buses 210 and 220, and an ordered array of resistance elements 230 connected therebetween. It is cut to a length appropriate to that of pipe 12 at cut edge 240.

A source of electrical potential 20 is connected to power buses 110 and 120 of heater 100 through connecting wires 22 and 24, respectively, and connection device 50. Electrical potential is coupled to power buses 210 and 220 of heater 200 through connecting wires 154 and 156, respectively, and connection device 250, from soldered connections to power buses 110 and 120 made at holes 150 and 152, respectively, in the insulating cover of heater 100.

Figure 2:
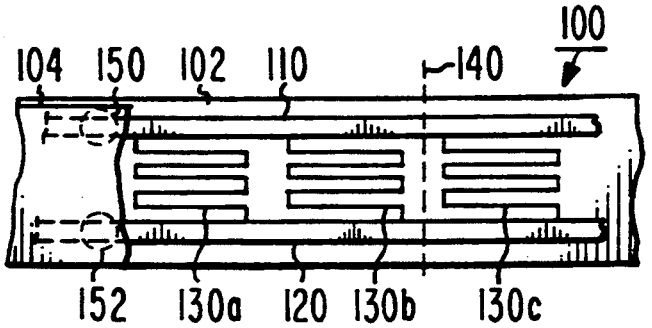
FIGS. 2, 3, 4 and 5 show embodiments of the resistance device according to the present invention.

In the embodiment of FIG. 2, heater 100 has electrically conductive power buses 110 and 120 spaced apart on a flexible substrate 102 of an insulating material. Substrate 102 is, for example, a long, narrow (e.g. $\frac{1}{4}$ inch) strip of thin (e.g. 0.005 inch) polyimide; thicknesses between 0.001 and 0.010 inch and widths between $\frac{1}{4}$ inch and 1 inch are common. Power buses 110 and 120 are preferably conventional copper printed circuit wiring. A plurality of resistance elements **130*a*, 130*b*, 130*c*. . . are arranged in an elongated array along substrate 102 and each is electrically connected between buses 110 and 120 for receiving electrical potential therefrom. The array of resistance elements is "ordered" in that the order of their respective physical locations along substrate 102 generally corresponds to the order of their electrical connections to power bus 110 and to power bus 120**.

A covering layer 104 of the same flexible insulating material as substrate 102 covers substrate 102, buses 110, 120 and resistance elements **130*a*, 130*b*, 130*c*. . . , but is shown cut away to reveal internal features of heater 100. Covering 104 includes perforated areas 150 and 152 that can be removed to provide access to buses 110, 120** for making electrical connections thereto, such as by soldering.

Resistance elements **130*a*, 130*b*, 130*c*. . . are serpentine elements of a conventional resistance-providing material. In a low voltage or high power application, for example, elements 130*a*, 130*b*, 130*c*. . . can be of Inconel 600, nichrome, cupro-nickel or similar material laid out with width, length and thickness selected in conventional manner to provide the desired resistance. In higher voltage or lower power applications where high resistance values are desired, serpentine resistance elements 130*a*, 130*b*, 130*c*. . . may be fabricated of vapor deposited semiconductor (such as germanium), indium tin oxide, or by a resistive ink applied by painting, screening or other known technique. Carbon-loaded or silver-loaded inks, for example, that cure at room temperature are available from Acheson Colloids, of Port Huron, Mich. In addition, ink systems of screen-printable polymers that cure at temperatures compatible with various substrate materials are available for fabricating both conductors, such as buses 110 and 120, and resistors, such as elements 130, on substrate 102**. These inks are available from ElectroScience Labs, of King of Prussia, Pa.

Those skilled in the art know that electrically conductive materials, such as the copper printed circuit wiring, have electrical resistance, and that resistance-providing materials as described above, are electrically conductive. Thus, while it is convenient to describe materials as "electrically conductive" or "resistive", these are in fact relative terms.

Because the resistance heater of the present invention preferably produces a predetermined power density over its length and has an ordered arrangement of its elements, it may be cut at any place along its length to a length appropriate to that of the workpiece, e.g., a tubular pipe, that it is desired to heat. Preferably, the heater 100 should be cut between resistance elements, such as along cut line 140 between elements 130*b* and 130*c*, however, if the cut is made through a resistance element the entire heater remains operable except for the extreme end for a distance that must be less than one inch divided by the pitch, i.e. the number of resistance elements per inch of length. The cut end can be insulated with polyimide tape.

Two examples of resistance devices follow.

EXAMPLE 1

If a 1 watt/in$^2$ power density is desired along a 1 inch-wide heater 100, and the available power source is 10 volts dc, then each inch of the length of heater 100 must dissipate 1 watt. Thus, for each inch, the resistance across buses 110, 120 must be:

$$R = \frac{V^2}{P} = \frac{(10V.)^2}{1W.} = 100\Omega \quad (1)$$

If each of resistance elements 130*a*, 130*b*, 130*c*. . . occupy 1 inch of length, then each must have a resistance of 100Ω. The resistance required varies directly with the pitch of the resistance elements, i.e. the number of elements per unit of length, as illustrated in the following table.

| Pitch (elements/inch) | Resistance (Ω, each element) | Effective Combined Resistance (Ω, each inch) | Power Per Inch (watts @ 10V) |
|---|---|---|---|
| 1 | 100 | 100 | 1 |
| 2 | 200 | 100 | 1 |
| 4 | 400 | 100 | 1 |

EXAMPLE 2

If a 0.08 watt/in$^2$ power density is desired along a $\frac{1}{4}$ inch wide heater 100, and the available power source is 70 volts dc, then each one inch length of heater must dissipate 0.02 watt and the resistance required for each inch of length is:

$$R = \frac{V^2}{P} = \frac{(70V.)^2}{0.02W.} = 245K\Omega \quad (2)$$

and a corresponding table, according to pitch, is:

| Pitch (elements/inch) | Resistance (Ω, each element) | Effective Combined Resistance (Ω, each inch) | Power Per Inch (watts @ 70V) |
|---|---|---|---|
| 1 | 245KΩ | 245KΩ | 20 mW |
| 2 | 490KΩ | 245KΩ | 20 mW |
| 4 | 980KΩ | 245KΩ | 20 mW |

As a practical matter, one might round off the resistance value (for example, 1MΩ) and adjust the pitch to compensate therefor.

Figure 3:
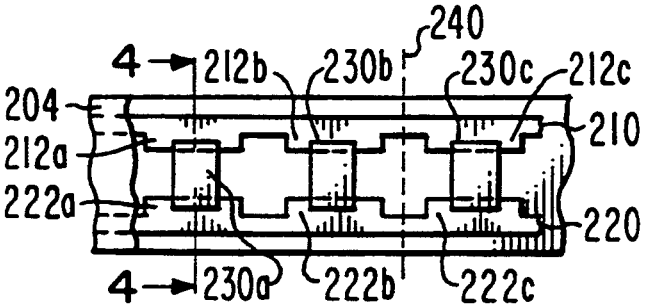

High value resistances, such as 1MΩ to 4MΩ, are difficult to achieve with the serpentine form of resistance elements described in relation to FIG. 2, however, they are readily available in the form of flat chip resistors available from several sources, including KOA Speer Electronics, Inc. of Bradford, Pa. FIG. 3 shows an embodiment employing such chip resistors in a heater 200 in which power buses 210 and 220 are spaced apart on a substrate 202 of a flexible substrate material and which includes a flexible cover, all as described in relation to FIG. 1. Power buses 210 and 220 have extended areas 212*a*, 212*b*, 212*c* and 222*a*, 222*b*, 222*c*, respectively, to facilitate mounting of the chip resistors 230*a*, 230*b*, 230*c*. . . such as by soldering or by bonding using an electrically conductive adhesive. As above, resistance heater 200 can be cut to the desired length at any location but preferably between ones of chip resisters 230*a*, 230*b*, 230*c* along cut line 240.

Figure 4:
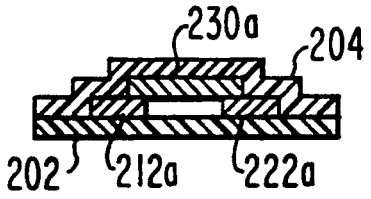

FIG. 4 is a cross-sectional view of heater 200 of FIG. 3 showing extended mounting areas 212*a* and 222*a* spaced apart on substrate 202 and chip resistance element 230*a* mounted, as by soldering, thereto. Insulating flexible cover 204 overlaps the foregoing, and is bonded in place such as by an adhesive, such as an FEP adhesive or a polyamide-imide adhesive such as Pyrolux available from E. I. dupont de Nemours and Company, Wilmington, Del. The overall thickness would be about 30–40 mils for 5 mil thick substrates and covers with a 20–25 mil thick chip resistor, in comparison to about 10 mils thickness for the embodiment of FIG. 2.

Figure 5:
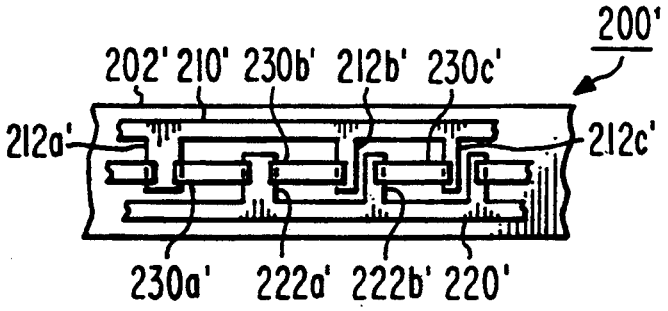

Because chip resisters 230*a*, 230*b*, 230*c* are mounted with their longest dimension transverse to the longitudinal axis of heater 200 in FIG. 3, heater 200 may be less flexible than desired in such transverse direction. The embodiment of FIG. 5 (in which there is correspondence of primed identifying numerals with the unprimed numerals of FIG. 3) overcomes this by orienting chip resisters 230*a*', 230*b*', 230*c*' with their long dimension generally along the longitudinal axis of heater 200'. Two alternative arrangements are shown in FIG. 5 for the chip resistor mounting areas. Respective ends of adjacent chip resisters 230*a*' and 230*b*' are mounted to area 222*a*' to electrically connect to power bus

220' and chip resistor 230*a*' is connected to area 212*a*' to electrically connect to power bus 210' as is the next adjacent chip resistor in the leftward direction. In a second alternative, mounting areas 212*b*' and 222*b*' extend from power buses 210' and 220', respectively, in the area between adjacent chip resistors 230*b*' and 230*c*'. The former arrangement may permit a somewhat greater pitch with somewhat lesser flexibility in the longitudinal direction whereas the second has a somewhat lesser pitch but somewhat greater flexibility. Where even greater flexibility is desired, a plurality of narrow chip resistors can be mounted side by side with their long axes as shown in FIG. 5.

Figure 6:
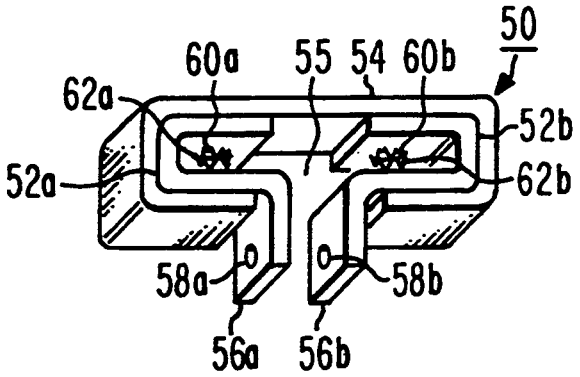
FIG. 6 shows a connection device useful with the present invention.

FIG. 6 is a connection device 50 of the sort referred to in relation to FIG. 1. Two electrically conductive metal clip elements 52*a* and 52*b* are held in opposing relationship by insulating tape 54 so that the respective U-shaped portions thereof form a substantially rectangular cavity 55 into which a resistance heater, such as heater 100 or heater 200, can be inserted. Holes 60*a* and 60*b* are punched into the U-shaped portions of elements 52*a* and 52*b*, respectively, in a conventional manner so as to create projecting points 62*a* and 62*b* extending into cavity 55 at locations that will permit them to pierce substrate 104 and electrically contact power buses 110 and 120 of heater 100 when the U-shaped portions of clips 52*a* and 52*b* are crimped closed on heater 100. Connection tabs 56*a* and 56*b* extend from clips 58*a* and 58*b* and have holes 58*a* and 58*b*, respectively, into which electrical wires can be connected, such as by soldering. Clips 52*a* and 52*b* can be fabricated of copper, aluminum or other suitable conductive metal and tape 54 can be a polyimide, polyester or the like material of suitable thickness, e.g., 5 or 10 mils.

The scope of the present invention is defined by the claims following and includes alternative embodiments as is appreciated by those of ordinary skill in the art. For example, resistance heaters 100 and 200 could be energized by either direct or alternating current power sources, or could be employed as elements exhibiting resistances rather than as heaters. Further in the embodiment of FIG. 2, for example, the serpentine resistor arrangement 130 could be fabricated with its longer legs perpendicular to power buses 110 and 120, or at another angle, rather than parallel thereto as illustrated.

In addition, the arrangements of power buses and resistances described herein can be replicated side by side on a wider substrate thereby providing a resistance device that can be cut to a desired length as described above but that also can be cut to a desired width. It is also convenient if measuring marks (in inches, centimeters, or the like) are printed on the cover of the strip or area heater to facilitate cutting the device to a desired dimension and calculating the resistance of a previously-cut device.

Alternatively, perforated areas 150 and 152 of FIG. 2 can be holes in the cover 104 through which electrical leads can be connected to buses 110 and 120; unused holes are covered by an insulating material, such as polyimide tape.

Moreover, it is not necessary that resistance elements employed in a resistance device have the same resistance value or that the pitch of the resistance elements be uniform over the length of the resistance device. By selecting the values of the resistances, various patterns of power density (or power per unit length) and distribution can be obtained. On the other hand, where an extremely uniform power density is desired, in addition to selecting equal resistance element resistance values, an aluminum heat spreader can be applied to the surface of the substrate opposite that on which the power buses and resistance elements are formed. Thin aluminum coatings can be obtained by vapor deposition whereas thicker coatings (e.g., 1 mil or greater) can be obtained by bonding sheet aluminum to that surface.

What is claimed is:

1. A resistance device comprising:

an elongated substrate of a flexible insulating material;

first and second elongated electrical conductors, mutually parallel and spaced apart on a surface of said substrate, for receiving electrical potential therebetween said first conductor including a plurality of first conductive areas extending in a direction toward said conductor and spaced along the length of said first conductor at predetermined intervals, and said second conductor including a plurality of second conductive areas extending in a direction toward said first conductor and spaced along the length of said second conductor at locations intermediate the locations of adjacent ones of said first conductive areas; and elongated resistance means defining an axis of elongation parallel to said elongated electrical conductors, said elongated resistance means being physically located between said elongated electrical conductors, and extending between, and being physically and electrically connected to, adjacent ones of said first and second conductive areas.

2. The resistance device of claim 1 wherein said resistance means comprises a plurality of chip resistors.

3. The resistance device of claim 2 wherein said chip resistors are soldered to predetermined locations on said first and second conductive areas extending respectively from said first and second conductors.

4. The resistance device of claim 3 wherein said chip resistors are rectangular and are arranged on said substrate with their longer dimension extending in substantially the same direction as said first and second conductors.

5. The resistance device of claim 1 wherein said first and second conductors are copper.

6. The resistance device of claim 1 further comprising a cover of a flexible insulating material overlying said substrate to enclose said conductors and said resistance means between said substrate and said cover.

7. The resistance device of claim 6 wherein said cover includes at least first and second areas that are one of removed and removable from said cover, said first and second areas being located over said first and second conductors, respectively, for permitting connection thereto when said first and second removable areas are removed.

8. The resistance device of claim 1 wherein said flexible insulating material is polyimide.

9. The resistance device of claim 1 further comprising an electrical connection including an electrically conductive member having a U-shaped portion for clamping to said substrate, said U-shaped portion having at least one projecting point for contacting one of said first and second conductors.

10. A resistance heater adapted to be cuttable to a desired length comprising:

an elongated, thin, narrow substrate of a flexible electrically insulating material;

first and second elongated, mutually parallel electrical buses lying on a first surface of said substrate, said first electrical bus being proximate to one elongated edge of said substrate and extending for a substantial part of the length thereof, said second electrical bus being proximate the other elongated edge of said substrate and extending for a substantial part of the length thereof, said first electrical bus including a plurality of first conductive areas extending in a direction toward said second electrical bus and spaced along the length of said first electrical bus at predetermined intervals, and said second electrical bus including a plurality of second conductive areas extending in a direction toward said first electrical bus and spaced along the length of said second electrical bus at predetermined locations intermediate the locations of adjacent ones of said first conductive areas; and elongated resistance means physically supported by said first surface of said substrate, and located between said first and second electrical buses with said direction of elongation parallel with said elongated edges of said substrate, said resistance means being physically and electrically connected to adjacent ones of said first and second conductive areas of said first and second electrical buses.

11. The resistance heater of claim 10, further comprising:

an elongated narrow cover of a flexible electrically insulating material and having substantially the same shape and size as said substrate, said cover being affixed to said first surface of said substrate, whereby said electrical buses and said resistance means are enclosed between said substrate and said cover; and first and second means respectively coupled to said first and second electrical busses through one of said substrate and said cover for receiving electrical potential from a source thereof.

12. The resistance heater of claim 10 wherein said resistance element comprises a plurality of chip resistors.

13. The resistance heater of claim 12 wherein said chip resistors are rectangular and are arranged on said substrate with their longer dimension in substantially the same direction as said first and second electrical buses.

14. The resistance heater of claim 13 wherein said chip resistors are soldered to predetermined locations on the first and second conductive areas extending respectively from said first and second electrical buses.

15. The resistance heater of claim 10 wherein said first and second electrical buses are copper.

16. The resistance heater of claim 10 wherein said flexible insulating material is polyimide.

17. The resistance heater of claim 10 wherein said cover includes at least first and second areas that are one of removed and removable from said cover, said first and second areas being located over said first and second electrical buses, respectively, for permitting connection thereto when said first and second removable areas are removed.

18. The resistance heater of claim 10 further comprising an electrical connection including an electrically conductive member having a U-shaped portion for clamping to said substrate and cover, said U-shaped portion having at least one projecting point for contacting one of said first and second electrical buses through one of said substrate and said cover.

* * * * *